United States Patent [19]

Cobey

[11] Patent Number: 4,468,128

[45] Date of Patent: Aug. 28, 1984

[54] CONTINUOUS CONVEYOR COMPOSTER METHOD AND APPARATUS

[76] Inventor: Herbert T. Cobey, P.O. Box 226, Iberia, Ohio 43325

[21] Appl. No.: 323,918

[22] Filed: Nov. 23, 1981

[51] Int. Cl.[3] ..... B01F 5/00

[52] U.S. Cl. ..... 366/156; 366/186; 366/319

[58] Field of Search ..... 366/156, 158, 177, 181, 366/182, 186, 290, 279, 35, 134, 155, 180, 241, 244, 345, 218, 152, 172, 179, 319; 414/310

[56] References Cited

U.S. PATENT DOCUMENTS

| | | | |
|---|---|---|---|
| 858,017 | 6/1907 | Pence | 366/155 |
| 2,373,638 | 4/1945 | Perkins | 118/DIG. 16 |
| 2,639,902 | 5/1953 | Kuebler | 366/290 |
| 2,781,563 | 2/1957 | Horth | 366/279 |
| 2,991,050 | 7/1961 | Small | 366/333 |
| 3,104,037 | 9/1963 | Myrum | 366/335 |
| 4,201,484 | 5/1980 | Sasiela | 366/156 |
| 4,298,288 | 10/1981 | Weisbrod | 366/37 |
| 4,358,205 | 10/1982 | Eakins | 366/150 |

FOREIGN PATENT DOCUMENTS

| | | | |
|---|---|---|---|
| 838593 | 5/1952 | Fed. Rep. of Germany | 366/156 |
| 643470 | 9/1950 | United Kingdom | 366/156 |

*Primary Examiner*—Stephen Marcus
*Assistant Examiner*—Brian J. Bowman
*Attorney, Agent, or Firm*—Leydig, Voit, Osann, Mayer & Holt, Ltd.

[57] ABSTRACT

A continuous conveyor composting apparatus to provide a method of completely mixing semi-solid sewage sludge, compost material and refuse into a non-compacted, readily compostable material. A variable capacity mixing chamber is provided to receive a partially mixed product from several hopper bins which are equipped with variable speed auger systems. The mixing chamber is equipped with a compost-throwing member which mixably engages the product to lift, separate and fluff the material.

11 Claims, 5 Drawing Figures

CONTINUOUS CONVEYOR COMPOSTER METHOD AND APPARATUS

FIELD OF THE INVENTION

This invention relates generally to a method and apparatus for compositing sewage sludge and other organic materials. More specifically, the invention embodies means for thoroughly mixing semi-solid sewage sludge, which is generally wet and sticky, with dryer compost and other organic refuse materials. The resulting product is a generally porous material which is ready for further composting.

BACKGROUND OF THE INVENTION

Prior to the present invention there has been no convenient and economically efficient means for properly mixing sewage sludge with other compostable products. As a result, it has been very expensive for municipalities to safely dispose of the vast amounts of sewage sludge generated by their inhabitants. In addition, improper handling or inadequate disposal systems create potential health hazards to the surrounding community. The present invention offers a safe method for disposing of sewage sludge which is both efficient from a cost standpoint and easily adaptable to accomodate the different output requirements of each community.

OBJECTS OF THE INVENTION

It is therefore an object of this invention to provide a mixing system that can continuously produce a uniform mixture of compostable material comprised of sewage sludge, refuse and other organic material.

Another object is to provide an efficient and economic method of treating the ever increasing amount of solid or semi-solid organic waste generated by society.

A further object is to provide a means of safely treating and handling solid or semi-solid organic waste and to reduce the potential for the creation of disease-causing bacteria growth commonly associated with decomposing organic waste materials.

Another object is to provide a system which can be easily modified to accommodate virtually any amount of output desired, from very large tonnage systems capable of meeting the requirements of large metropolitan areas, to more modest systems for smaller communities.

An important object of this invention is to provide equipment which is essentially maintenance free and requiring only a minimum amount of manual labor to operate, while at the same time providing an efficient method of pre-mixing the compostable material.

These and other objects and advantages will become more readily apparent upon reading the following detailed description.

SUMMARY OF THE INVENTION

During operation, sewage sludge, compost and other organic refuse materials are separately located in hopper bins. Augers, driven by variable speed motors, transport the materials from the hopper bins into a mixing chamber. A conveyor belt in the mixing chamber transports the now combined materials to a rotating, compost-throwing member wherein the materials are thoroughly intermixed to provide a uniform composition of sewage sludge, compost and organic refuse.

Finally, the mixed product is discharged from the machine to be transported away for further processing.

It is important to note that while the following description details certain particular embodiments and procedures of the invention, other embodiments and methods are readily contemplated and also fall within the scope and spirit of the invention.

DETAILED DESCRIPTION OF THE INVENTION

Figures 1, 2, 3, 4, 5:
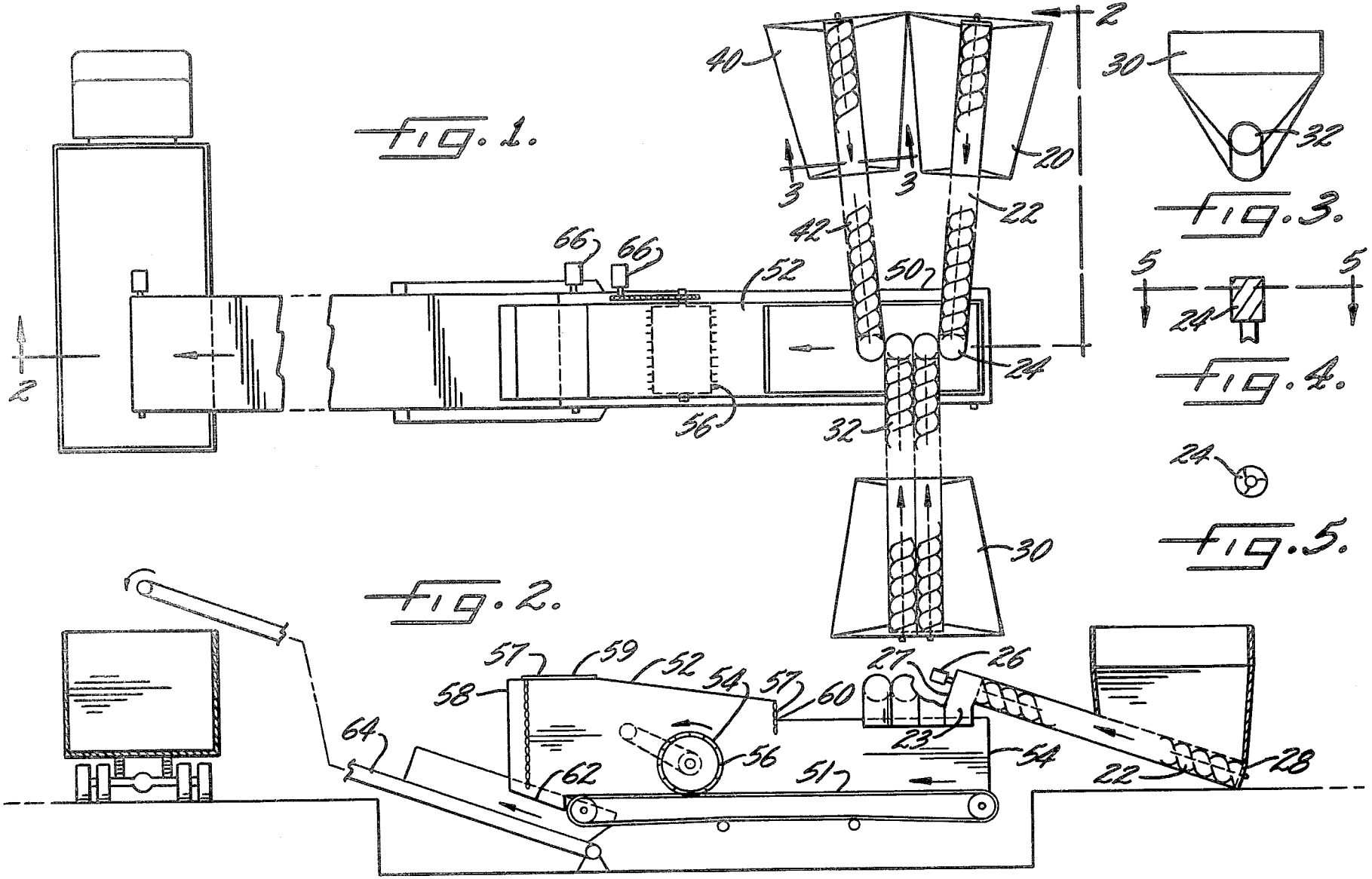
FIG. 1 is a top plan view of the preferred form of the invention showing the various hopper bins equipped with auger systems and the two mixing chambers.
FIG. 2 is a cross-sectional view of the mixing chambers and discharge system with a fragmented side view of a hopper bin and auger system.
FIG. 3 is a cross-sectional view of a hopper bin showing the tapered sides and auger location.
FIG. 4 is a detailed side view of the screw-type paddles mounted at the discharge end of the augers.
FIG. 5 is a cross-sectional view taken substantially along line 5—5 showing a screw-shaped paddle.

Turning to the drawings, FIG. 1 shows an overall view of the continuous conveyor composting system of the present invention, particularly detailing the preferred arrangement of the various component parts. Those experienced in the art will understand that it is desirable to combine wet, sticky sewage sludge with other dryer organic materials or refuse such as shredded paper, wood chips, sawdust and the like. To enhance product mixing, a simple auger arrangement is provided as described below.

A plurality of hopper bins (in this case three) 20, 30 and 40 are positioned on one or both sides of a first mixing chamber 50. The hopper bin 20 may function as a receptacle for compost material, i.e., partially decomposed, solid or semi-solid, organic waste, and may be a commercially available hopper bin of suitable size and shape. The preferred embodiment calls for a hopper bin with a trapezoidal-shaped upper portion with substantially vertical sidewalls, while the lower sidewalls of bin 20 taper inwardly toward each other. As compost is removed from the bin, the tapered sides facilitate the gravitation of the material to the bottom of the bin. The hopper bin can be refilled by any suitable means such as a front-end loader or conveyors. Located at the bottom of bin 20 is a screw auger 22 which provides the transfer mechanism between bin 20 and the first mixing chamber 50. As compost gravitates to the bottom of bin 20, it falls into auger 22 which is rotating, causing the compost to be carried along its length by a spiraling action. Auger 22 is inclined at an angle (see FIG. 2), the angle being easily adjustable to suit individual needs by simply raising or lowering the auger end 28 to any desired height. The angle is preferably less than 45° with respect to the ground. The auger is supported at its raised end by support member 23 which is fastened to mixing chamber 50, while the lower end is supported by the hopper sidewall. Similar single or double screw augers 42 and 32 are located in hoppers 40 and 30.

To facilitate mixing, the augers 22, 32 and 42 have screw-shaped paddles 24 at their discharge ends. The paddles rotate in such a manner as to mixably toss the compost material from hopper 20 into the discharge of the sewage sludge from double screw auger 32 and the refuse single screw auger 42. This is the first mixing action the materials encounter before entering first mixing chamber 50.

Auger 22 is equipped with a variable speed hydraulic motor 26 which enables the auger system to operate at varying outputs. Although a hydraulic motor is preferred, any suitable driving means can accomplish the same objective, for example, an electric motor equipped with a rheostat. The motor 26 is located above the discharge end 27 of the auger 22.

The sewage sludge hopper bin 30 and the refuse hopper bin 40 have the same basic construction as the compost hopper bin 20 described above. The refuse hopper bin 40 is equipped with a single screw auger 42; and the sewage sludge hopper bin is preferably equipped with a double screw auger 32. Desirably, refuse bin 40 is located beside compost bin 20 and on the side of mixing chamber 50 opposite that of sewage sludge bin 30. With this arrangement, the discharge of both single screw augers 22 and 42 feed directly into the discharge of the sewage sludge double screw auger 32, enhancing the mixing of the materials. Alternatively, one of the hoppers may be located in line with the mixing chamber 50.

In the preferred embodiment, the single screw auger 42 and the double screw auger 32 are both equipped with variable speed hydraulic motors 26, such as previously described. Additionally, both augers 32 and 42 are equipped with screw-shaped paddles 24, also previously described.

The inclination of sewage sludge auger 32 may be at a lesser angle than that of the other two augers because the semi-solid consistency of the sewage sludge will have a tendency to allow it to gravitate back into the sewage sludge hopper bin. This can be compensated for, to an extent, by simply increasing the speed of the variable speed hydraulic motor 26, or by reducing the inclination of the auger. FIG. 2 shows the compost screw auger 22 resting on a platform at its lower end and inclined at an angle of approximately 30°. Those experienced in the art realize that the augers' inclinations can be easily varied by changing the platform height.

First mixing chamber 50 is located directly beneath the discharge of the augers so that the various materials are discharged into one another as they mixably fall into chamber 50. The bottom of chamber 50 comprises an endless conveyor belt 51 which travels counterclockwise as shown in FIG. 2 carrying material to a second mixing chamber 52.

The second mixing chamber 52 is equipped with a compost-throwing member 54 which is similar to the compost-throwing member described in U.S. Pat. No. 3,369,797. Compost-throwing member 54 is mounted so that it rotates in a counterclockwise direction, i.e., the same direction as the conveyor when viewing FIG. 2. As the product engages member 54, it is lifted into the air by a number of radially projecting teeth 56 located on the member 54. The radially projecting teeth 56 are arranged so that they break up the sludge and intermix it with dry compost and other refuse material. Thorough mixing at this stage prevents problems related to poor composting such as odor, poor coliform kill and a wet or unfinished end product. Additionally, the product is fluffed up and thoroughly mixed by the compost-throwing member whereupon it falls onto a second belt conveyor 64 to be transported out of the second mixing chamber 52.

A chain curtain 57 is located near the end wall 58 of the second mixing chamber 52 to protect the wall of the chamber from material projected by the rotating compost-throwing member 54. The curtain 57 is suspended from the ceiling 59 of the second mixing chamber and is long enough to protect the entire end wall 58. Also, a shorter chain curtain 57 is suspended from the ceiling 59 and is located near chamber opening 60 which separates the two mixing chambers. This chain curtain extends downward and prevents material from being projected out of the machine by member 54.

Once the material is thoroughly mixed by the compost-throwing member, it is removed from the second mixing chamber 52 by the conveyor 51 through discharge chute 62. The material leaves discharge chute 62 and falls by gravity onto the conveyor 64. The conveyor 64 can be of any conventional belt conveyor which is capable of transferring the finished product to a truck or other means to haul it away.

Motors 66 are provided to drive the conveyors 51 and 64 and the compost-throwing member 54. These motors may be of any conventional type, such as an electric or hydraulic motor, and are preferably of a commercially available type.

During operation, material in the various hopper bins is transferred to the first mixing chamber by augers. The augers are situated such that their discharges are into one another, thereby initiating mixing. Also, each auger is equipped with screw-shaped paddles to enhance product mixing during this discharge. After the partially mixed product falls into the first mixing chamber, it is transported to the second mixing chamber by a belt-type conveyor. The product engages the compost-throwing member in the second mixing chamber where it is thoroughly mixed by separating and fluffing the various materials so that the resulting product will be porous and readily compostable. The finished product is then removed from the second mixing chamber to be hauled away.

It is to be understood that the description and form of my invention, as described here and in the claims, is only the preferred example and that the size, location or capacity of the system can be varied without departing from the spirit of the invention.

I claim as my invention:

1. A conveyor composting apparatus for continuously mixing sewage sludge, compost, refuse and other organic material into a porous readily compostable product, said apparatus comprising, in combination:

a first mixing chamber to receive compost, sewage sludge, refuse or other organic material;

means for receiving and transferring organic waste, said means including a compost hopper bin for temporary storage and a screw auger means to transfer said organic waste from said compost hopper bin into said first mixing chamber;

means for accepting and transferring sewage sludge, said means including a sewage sludge hopper bin for temporary storage and a screw auger means to transfer said sewage sludge from said sewage sludge hopper bin into said first mixing chamber;

means for accepting and transferring refuse, said means including a refuse hopper bin for temporary storage and a screw auger means to transfer said refuse from said refuse hopper bin into said first mixing chamber, said compost hopper bin, said sewage sludge hopper bin and said refuse hopper bin having sidewalls gradually tapering toward the bottom such that they are spaced apart at the bottom a distance substantially equal to the width of the respective screw auger provides means for transporting said materials from the bottom of said hopper bins in an upward angular direction to an area directly above said first mixing chamber and for discharging said materials into said first mixing chamber, said auger means being disposed in the bottom of said respective hopper bins and having screw shaped paddles located at the discharge end of each screw augers to facilitate mixing said compost material;

a second mixing chamber;

means for transferring partially mixed compostable product from said first mixing chamber to said second mixing chamber;

means for further mixing said partially mixed compostable product into a finished compostable product including a compost-throwing member; and means for removing said finished compostable product from the composting apparatus.

2. An apparatus as defined in claim 1, wherein said compost-throwing member includes a plurality of radially projecting elements, said compost-throwing member being rotably mounted in said second mixing chamber and engaging said partially mixed material whereby said radially projecting elements lift, separate and fluff said material to assure complete intermixing of all of said sewage sludge, compost and refuse, the resulting mixture being a non-compacted readily compostable material.

3. A continuous conveyor composting apparatus as defined in claim 1, wherein a means is provided for transporting said compostable material away from said discharge area of said second mixing chamber, said means including a conveyor system located to receive the discharge of said compostable material from said second mixing chamber at its one end and to transport said compostable material in an upward angular direction to discharge the same into any suitable receiving device.

4. A conveyor composting apparatus for continuously mixing sewage sludge, compost, refuse and other organic material into a porous readily compostable product said apparatus comprising, in combination:

a first mixing chamber to receive compost, sewage sludge, refuse or other organic material;

means for receiving and transferring organic waste, said means including a compost hopper bin for temporary storage and a screw auger means to transfer said organic waste from said compost hopper bin into said first mixing chamber;

means for accepting and transferring sewage sludge, said means including a sewage sludge hopper bin for temporary storage and a screw auger means to transfer said sewage sludge from said sewage sludge hopper bin into said first mixing chamber;

means for accepting and transferring refuse, said means including a refuse hopper bin for temporary storage and a screw auger means to transfer said refuse from said refuse hopper bin into said first mixing chamber;

a second mixing chamber;

means for transferring partially mixed compostable product from said first mixing chamber to said second mixing chamber, and said means for transferring the combined material in said mixing chambers including a continuous feed conveyor, said conveyor extending in the direction of the longitudinal axis of said first and second mixing chambers and comprising the entire floor portion of said first mixing chamber and partially comprising the floor portion of said second mixing chamber;

means for further mixing said partially mixed compostable product into a finished compostable product including a compost-throwing member; and means for removing said finished compostable product from the composting apparatus.

5. An apparatus as defined in claim 4, wherein said compost hopper bin, said sewage sludge hopper bin and said refuse hopper bin are of a variable discharge, non-clogging type and have sidewalls gradually tapering toward the bottom such that they are spaced apart at the bottom a distance substantially equal to the width of the respective transfer means.

6. An apparatus as defined in claim 4, wherein the transfer means for compost includes a screw auger which provides a means for transporting said compost material from the bottom of said compost hopper bin in an upward angular direction to an area directly above said first mixing chamber and discharging said compost material into said first mixing chamber, said auger being disposed in the bottom of said compost hopper bin.

7. An apparatus as defined in claim 4, wherein said screw auger is equipped with screw shaped paddles, located at its discharge end, to facilitate mixing said compost material into the auger discharge ends of said sewage sludge and said refuse transfer means.

8. An apparatus as defined in claim 4, wherein the transfer means for sewage sludge includes at least one screw auger which provides a means for transporting said sewage sludge material from the bottom of said sewage sludge hopper bin in an upward angular direction to an area directly above said first mixing chamber, said auger being disposed in the bottom of said sewage sludge hopper bin.

9. An apparatus as defined in claim 4, wherein the transfer means for refuse includes a screw auger which provides a means for transporting said refuse material, from the bottom of said refuse hopper bin in an upward angular direction to an area directly above said first mixing chamber, said single screw auger being disposed in the bottom of said refuse hopper bin.

10. An apparatus as defined in claim 4, wherein said refuse hopper bin and said compost hopper bin are located on one side of said first mixing chamber while said sewage sludge hopper bin is located on the opposite side of said first mixing chamber, said refuse auger and said compost augers from said bins being located on either side of said sewage sludge augers such that the discharge from all of said augers mixably falls into said first mixing chamber.

11. An apparatus as defined in claim 4, wherein said conveyor has a variable speed drive motor for facilitating different rates of output.

* * * * *